US006109243A

United States Patent [19]

Seyerle

[11] Patent Number: 6,109,243

[45] Date of Patent: Aug. 29, 2000

[54] MARINE FUEL TANK PUMP

[75] Inventor: Carl Seyerle, Cordova, Tenn.

[73] Assignee: INDMAR Products Co., Inc., Millington, Tenn.

[21] Appl. No.: 09/072,972

[22] Filed: May 5, 1998

[51] Int. Cl.[7] ..... F02M 37/04

[52] U.S. Cl. ..... 123/467; 123/514; 123/509

[58] Field of Search ..... 123/509, 495, 123/497, 467, 510–511, 458, 514, 506

[56] References Cited

U.S. PATENT DOCUMENTS

| | | | |
|---|---|---|---|
| 3,658,444 | 4/1972 | Rhodes et al. | 417/423 |
| 4,782,808 | 11/1988 | Bostick et al. | 123/467 |
| 4,974,570 | 12/1990 | Szwargulski et al. | 123/509 |
| 5,074,272 | 12/1991 | Bostick et al. | 123/467 |
| 5,159,911 | 11/1992 | Williams et al. | 123/467 |
| 5,170,764 | 12/1992 | Tuckey | 123/509 |
| 5,330,475 | 7/1994 | Woodward et al. | 123/509 |
| 5,339,785 | 8/1994 | Wilksch | 123/467 |
| 5,363,827 | 11/1994 | Siekmann | 123/509 |
| 5,368,001 | 11/1994 | Roche | 123/510 |
| 5,408,970 | 4/1995 | Burkhard et al. | 123/467 |
| 5,456,235 | 10/1995 | Porter | 123/509 |
| 5,673,670 | 10/1997 | Powell et al. | 123/497 |
| 5,699,859 | 12/1997 | Poirier | 417/434 |
| 5,762,047 | 6/1998 | Yoshioka et al. | 123/509 |
| 5,785,025 | 7/1998 | Yoshiume et al. | 123/497 |
| 5,797,374 | 8/1998 | Minagawa et al. | 123/497 |

FOREIGN PATENT DOCUMENTS

| | | | |
|---|---|---|---|
| 0200663 | 12/1982 | Japan | 123/516 |
| 0048768 | 3/1983 | Japan | 123/516 |

*Primary Examiner*—Thomas N. Moulis
*Attorney, Agent, or Firm*—Wood, Phillips, VanSanten, Clark & Mortimer

[57] ABSTRACT

A marine fuel tank pump comprises a container for assembly into a marine fuel tank. An electric fuel pump is housed in the container. The pump has an inlet receiving fuel from the tank and an outlet. A pressure release is operatively associated with the outlet for releasing pressure from the outlet into the fuel tank when the pump is deenergized.

14 Claims, 3 Drawing Sheets

MARINE FUEL TANK PUMP

FIELD OF THE INVENTION

This invention relates to a marine fuel tank pump and, more particularly, to a pump assembled into a fuel tank.

BACKGROUND OF THE INVENTION

A conventional marine fuel injection system is used to deliver fuel to a marine power unit such as an inboard engine including a port fuel injection system. Fuel is stored in a tank and must be transferred to the engine. A fuel pump is used to deliver fuel from the tank to the engine. The fuel pump is mounted between the tank and the engine. Numerous connections, such as fittings, are required for delivering fuel from the tank to the pump and returning unused fuel to the tank.

The traditional fuel supply system can cause problems due to complexity and the number of connections.

Electric fuel pumps have been mounted in fuel tanks in automotive applications. However, marine applications are subject to unique environmental and regulatory constraints which have precluded mounting of the fuel pump in the fuel tank.

The present invention is directed to overcoming one or more of the problems discussed above in a novel and simple manner.

SUMMARY OF THE INVENTION

In accordance with the present invention there is provided an electric fuel pump housed in a container in a marine fuel tank.

Broadly, there is disclosed herein a marine fuel tank pump comprising a container for assembly into a marine fuel tank. An electric fuel pump is housed in the container. The pump has an inlet receiving fuel from the tank and an outlet. A pressure release means is operatively associated with the outlet for releasing pressure from the outlet into the fuel tank when the pump is deenergized.

It is a feature of the invention that the pressure release means comprises an orifice in the outlet.

It is another feature of the invention that the pressure release means comprises a pressure regulator connected to the output. The pressure regulator releases excess pressure back into the fuel tank.

It is a further feature of the invention to provide a fuel filter operatively connected into the inlet.

It is yet another feature of the invention to provide a fuel filter operatively associated with the container for filtering fuel to the inlet.

More particularly, a pressure regulator is connected to the outlet of the pump and contained within the cartridge. Additionally, a method is intended to release system pressure when the system shuts down. Alternatively, a controlled, very small orifice at the outlet permits a continuous bleed into the fuel tank or into the container within the fuel tank.

Further features and advantages of the invention will be readily apparent from the specification and from the drawing.

DETAILED DESCRIPTION OF THE INVENTION

Figure 1:
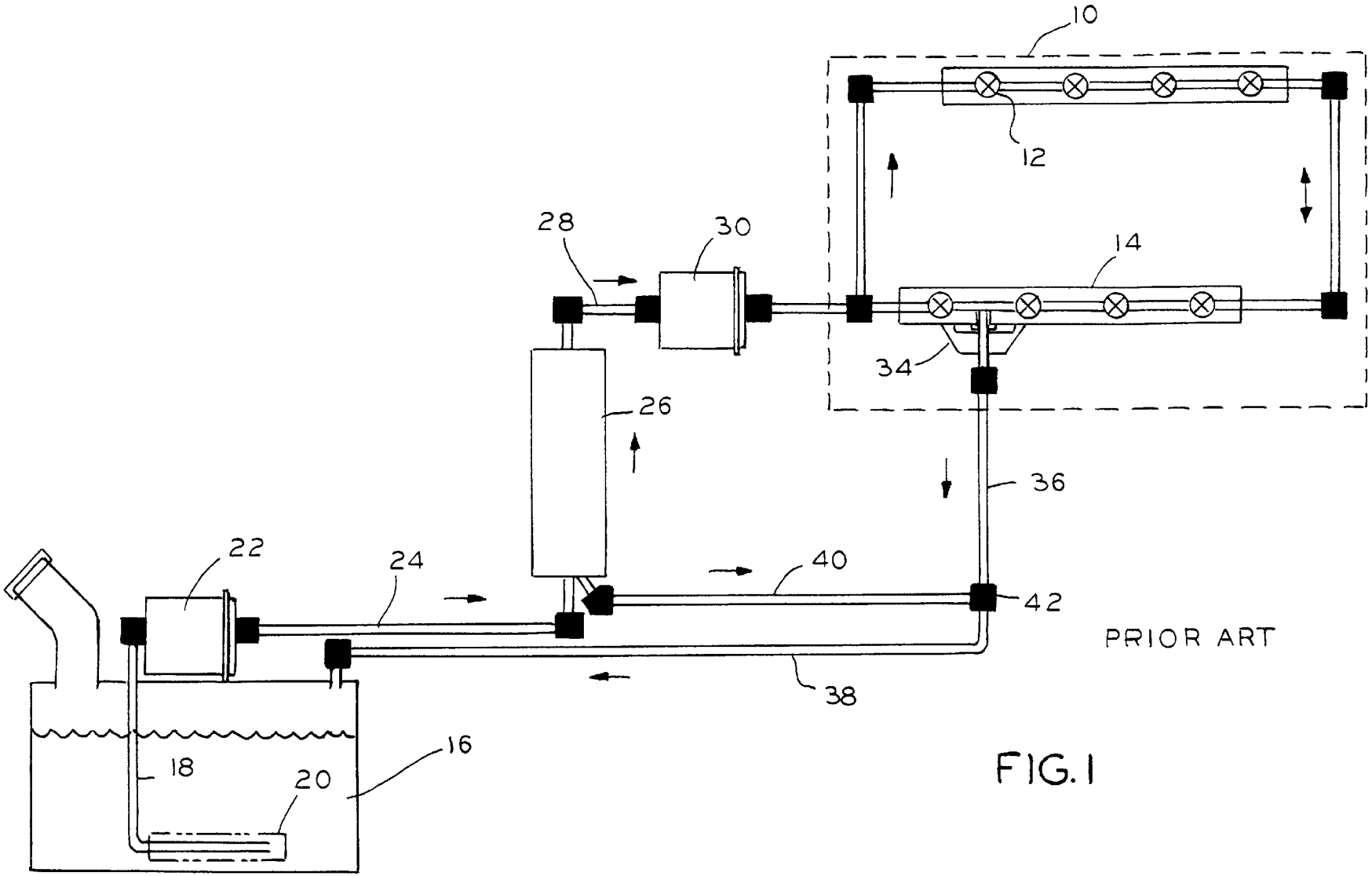
FIG. 1 is a schematic of a prior art marine fuel system.

Referring initially to FIG. 1, a typical prior art fuel system is illustrated for a marine engine 10. The engine 10 includes multiport injectors 12 and 14. Fuel is supplied from a tank 16. A hose 18 surrounded by a strainer 20 is received in the tank 16. The hose 18 is connected to a filter 22. The filter 22 is connected via a hose 24 to a pump 26. The pump 26 is connected via a hose 28 to a filter 30. The filter 30 is connected via a hose 32 to the engine 10.

The engine 10 includes a pressure regulator 34 connected to a hose 36. The hose 36 is connected to a return hose 38. Also connected to the return hose 38 is a hose 40 from a return outlet of the pump 26.

Although not specifically described, the hoses and devices are connected via fittings, such as fitting 42. Flow is in the direction of the arrows.

As can be seen with the typical marine fuel system, numerous fittings and hoses are required. The complexity of the hoses and fittings causes the fuel system to be prone to fuel handling problems. In accordance with the invention, a fuel injection system is provided for marine engines which is much simpler and has fewer connections.

Figure 2:
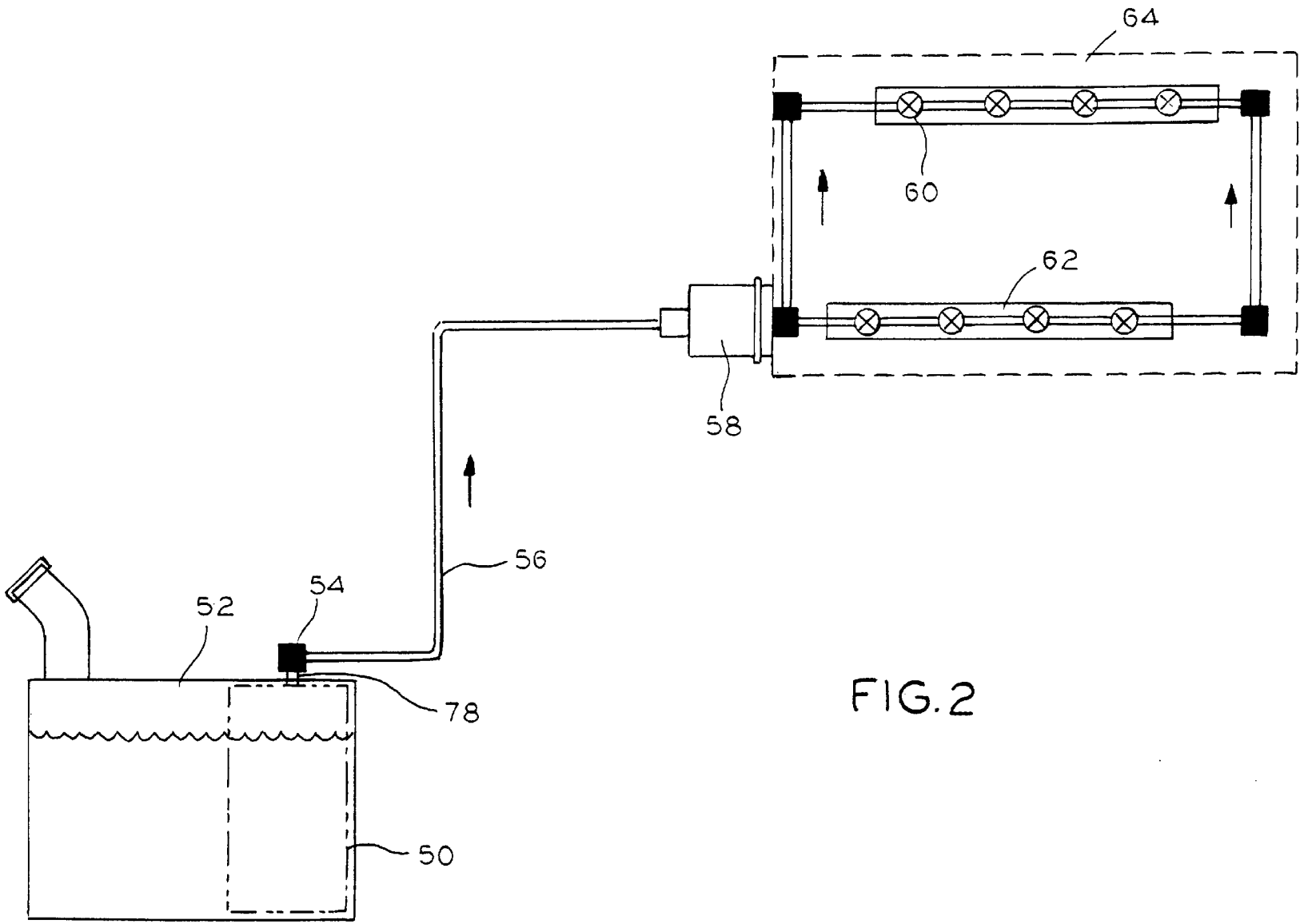
FIG. 2 is a schematic of a marine fuel system according to the invention.

Referring to FIG. 2, a fuel system utilizing a marine fuel tank pump 50 according to the invention is illustrated. The fuel tank pump 50 fits within a fuel tank 52. The pump 50 is connected via a fitting 54 to a hose 56, which is in turn connected to a filter 58. The filter 58 is connected to multiport fuel injectors 60 and 62 of a marine engine 64.

Figure 3:
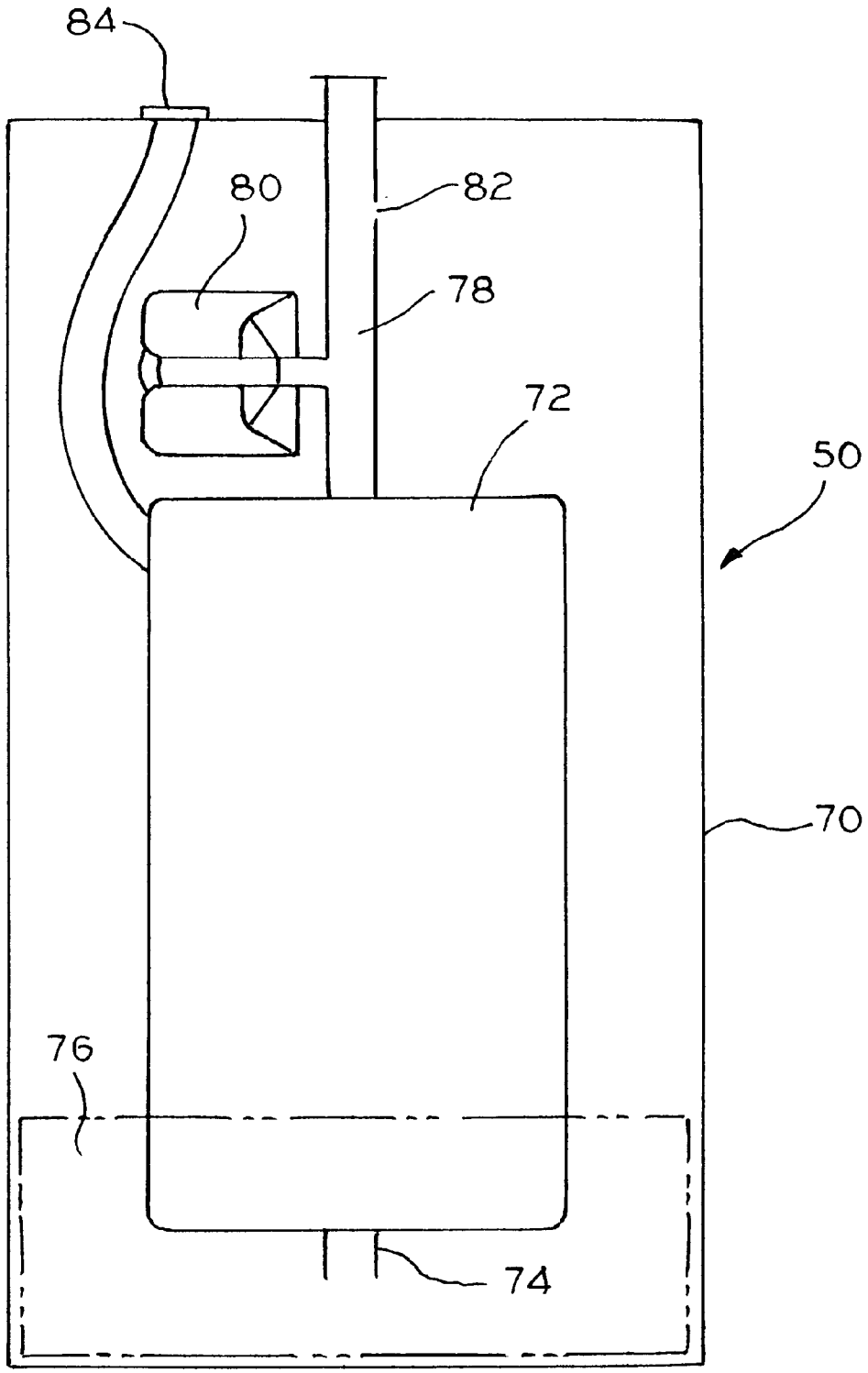
FIG. 3 is a side elevation view of a marine fuel tank pump according to the invention.

Referring to FIG. 3, the fuel tank pump 50 is illustrated in greater detail. The pump 50 comprises a pump in-tank cartridge including a container 70 for assembling into a marine fuel tank, as shown in FIG. 2. An electric fuel pump 72 is housed in the container 70. The pump 72 has an inlet 74. Located at the bottom of the container 70 about the inlet 74 is a primary fuel filter/strainer 76 of about 70 micron rating. The filter may be attached to the pump inlet 74 as a sock-type strainer as shown, or it may surround and encase the pump as a high capacity filter. The filter 76 may be treated with chemicals to reject water and acts as a primary water separator. Fuel in the tank is filtered via the filter 76 prior to entry into the inlet 74.

The pump 72 has an outlet 78. Connected to the outlet 78 is a pressure regulator 80 rated according to the particular application. For typical port fuel injection systems, the working pressure is nominally 35–45 psi, while for throttle body injected systems the working pressure is nominally 25–35 psi. For carburetors the working pressure is typically 3.5–10 psi. The pressure regulator 80 releases excess pressure. Additionally, a method is provided to release system pressure when the system shuts down. That is accomplished either electrically or mechanically. If the supply flow stops, the system pressure as controlled by the pressure regulator 80 is limited. If the signal to the fuel pump 72 stops, then the system pressure is also released. The purpose is to release system pressure any time that the engine is shut down. Alternatively, the pressure release may be accomplished with a device as simple as a controlled, very small orifice 82 at the outlet of the pressure regulator 80 permitting a continuous bleed into the fuel tank 52 or into the container 70 within the fuel tank 52. The pressure release may also be accomplished using a solenoid valve to dump pressure when the pump 72 is not energized.

The outlet 78 exits the cartridge 70 and tank 52. It has a high quality, high integrity fitting 54, see FIG. 2, such as an SAE O-ring facial fitting or a refrigeration type O-ring fitting.

The fuel hose 56 from the pump 50 to the engine 64 is a high integrity line of a stainless steel, either armored or heavy wall, or a recognized fuel hose of a construction type which accomplishes an armored construction. The length of the hose 56 is determined by and is specific to the boat application. It is to be terminated and permanently attached to fittings of a type corresponding to the fitting 54.

The filter 58 comprises a high integrity fuel filter of non-corrosive construction, serviceable or replaceable, with a rating of about ten microns. The filter has an integral fitting of the type described above at the inlet and a corresponding type of fitting matching the fuel distribution device for the system: in the case of a port fuel injection system, typically a fuel rail; in the case of a throttle body injection system, typically a throttle body and carbureted systems connected to the carburetor inlet. A pressure check port such as a Schrader valve may be incorporated at that junction.

In accordance with the preferred embodiment of the invention, the fuel injection system is returnless. Alternatively, the system may incorporate a return for excess fuel to the tank 52. If a return is to be incorporated, then the lines and fittings would be of a type and integrity concurrent with the supply lines, as discussed above.

A two-wire polarized weathertight connector 84 is shown for supplying control power to the pump 72 and regulator 80, where required.

The fuel injection system described herein is intended for use in gasoline fueled marine power units that are not solely restricted to gasoline. Gasoline/alcohol blends, alcohol, or other liquid fuels, including diesel fuel, can be used with the described marine fuel tank pump 50.

The tank cartridge 70 may incorporate baffling to prevent performance problems from fuel sloshing. It may provide for a reserve fuel capacity and fuel level sensing unit. Likewise, it may utilize a water/contaminant sensor.

Thus, in accordance with the invention, a fuel injection system overcomes fuel handling problems associated with the marine industry. This is accomplished through the simplicity of the system using very few connections, with those connections being of a high integrity type. Inherent in the simplicity is high quality and an obvious improvement in product safety. Inherent also in the simplicity is a high level of reliability. That reliability improves the performance of the boat and customer satisfaction. In accordance with the invention there is disclosed a marine fuel pump which fits within the fuel tank.

I claim:

1. A marine fuel tank pump comprising:

a container for assembly into a marine fuel tank;

an electric fuel pump housed in the container, the pump having an inlet receiving fuel from the fuel tank and an outlet, a portion of the outlet being housed in the container; and a pressure release means operatively associated with the outlet in the container for releasing pressure from the outlet directly into the fuel tank when the pump is de-energized.

2. A marine fuel tank pump comprising:

a container for assembly into a marine fuel tank;

an electric fuel pump housed in the container, the pump having an inlet receiving fuel from the fuel tank and an outlet;

a pressure release means operatively associated with the outlet for releasing pressure from the outlet into the fuel tank when the pump is deenergized, wherein the pressure release means comprises an orifice in the outlet.

3. The marine fuel tank pump of claim 1 wherein the pressure release means comprises a solenoid valve connected to the outlet.

4. The marine fuel tank pump of claim 3 wherein the pressure regulator limits pressure if supply flow from the outlet stops.

5. The marine fuel tank pump of claim 3 wherein the system releases pressure in absence of a control signal to the electric fuel pump.

6. The marine fuel tank pump of claim 1 further comprising a fuel filter operatively connected to the inlet.

7. The marine fuel tank pump of claim 1 further comprising a fuel filter operatively associated with the container for filtering fuel to the inlet.

8. A marine fuel system comprising:

a marine fuel tank supplying fuel for delivery to a marine engine;

a fuel pump including a container for assembly into the marine fuel tank, an electric fuel pump housed in the container, the pump having an inlet receiving fuel from the fuel tank and an outlet, with at least a portion of the outlet being in the container, a pressure release means operatively associated with the outlet within the container for releasing pressure from the outlet directly into the fuel tank when the pump is de-energized; and means connecting the outlet to the marine engine.

9. A marine fuel system comprising:

a marine fuel tank supplying fuel for delivery to a marine engine;

a fuel pump including a container for assembly into the marine fuel tank, an electric fuel pump housed in the container, the pump having an inlet receiving fuel from the fuel tank and an outlet, a pressure release means operatively associated with the outlet for releasing pressure from the outlet into the fuel tank when the pump is deenergized, wherein the pressure release means comprises an orifice in the outlet; and means connecting the outlet to the marine engine.

10. The marine fuel system of claim 8 wherein the pressure release means comprises a solenoid valve connected to the outlet.

11. The marine fuel system of claim 10 wherein the pressure regulator limits pressure if supply flow from the outlet stops.

12. The marine fuel system of claim 10 wherein the system releases pressure in absence of a control signal to the electric fuel pump.

13. The marine fuel system of claim 8 further comprising a fuel filter operatively connected to the inlet.

14. The marine fuel system of claim 8 further comprising a fuel filter operatively associated with the container for filtering fuel to the inlet.

* * * * *